US008324489B1

(12) United States Patent
Chapman

(10) Patent No.: US 8,324,489 B1
(45) Date of Patent: Dec. 4, 2012

(54) "RAILBOARD" FINGERBOARD WITH INTEGRATED FRETS FOR STRINGED MUSICAL INSTRUMENTS

(76) Inventor: Emmett H. Chapman, Woodland Hills, CA (US)

( * ) Notice: Subject to any disclaimer, the term of this patent is extended or adjusted under 35 U.S.C. 154(b) by 60 days.

(21) Appl. No.: 12/387,998

(22) Filed: May 12, 2009

(51) Int. Cl.
*G10D 1/08* (2006.01)

(52) U.S. Cl. ..... 84/314 R

(58) Field of Classification Search ..... 84/267, 84/290–293, 314 R
See application file for complete search history.

(56) References Cited

U.S. PATENT DOCUMENTS

| | | | | |
|---|---|---|---|---|
| 3,833,751 | A | 9/1974 | Chapman | |
| 3,868,880 | A | 3/1975 | Chapman | |
| 4,064,780 | A * | 12/1977 | Bond | 84/314 R |
| 4,145,948 | A * | 3/1979 | Turner | 84/293 |
| 4,290,336 | A | 9/1981 | Peavey | |
| 4,557,174 | A | 12/1985 | Gressett, Jr. | |
| 4,953,435 | A | 9/1990 | Chapman | |
| 5,033,351 | A | 7/1991 | Nomura | |
| 5,233,122 | A | 8/1993 | Kim | |
| 5,337,644 | A | 8/1994 | Fishman et al. | |
| 5,864,073 | A | 1/1999 | Carlson | |
| 6,657,113 | B2 | 12/2003 | Herman | |
| 2006/0096438 | A1 * | 5/2006 | Clark | 84/290 |

* cited by examiner

*Primary Examiner* — Kimberly Lockett
(74) *Attorney, Agent, or Firm* — J. E. McTaggart

(57) ABSTRACT

For a stringed musical instrument of a type that includes guitars, electric bass guitars, and two-handed tapping instruments including the Chapman Stick ®, in departure from conventional frets inserted individually into slots or channels in a wooden fretboard/neck, a Railboard (TM) is made with frets that are precision-machined under CNC (computer numeric control) integral with the fretboard from a single block of rigid material such as aluminum. Optionally the instrument neck, whether body-attached or of through-neck construction, may also be integrated into the Railboard along with the fretted fingerboard. The fret-tips are initially machined with a sharp apex, then machine-dressed to form narrow flat fret-tip plateaus all aligned in a common plane, then selected frets are further precision machine-dressed to provide "relief" in a lower-pitched region of the fretboard for optimal "low action" playing characteristics, thus producing instruments of uniform quality in a cost-effective manner.

28 Claims, 2 Drawing Sheets

"RAILBOARD" FINGERBOARD WITH INTEGRATED FRETS FOR STRINGED MUSICAL INSTRUMENTS

FIELD OF THE INVENTION

The present invention relates to fretted stringed musical instruments, generally of the guitar family, and more particularly to an improved instrument neck/fretboard structure designated as the Railboard (TM) which is accurately machined under CNC (computer numeric control) to include a set of integral frets and optionally including the entire neck portion. CNC machining of the Railboard facilitates efficient uniform production of stringed instruments with the integral fret-tips readily optimized for "relief" at a lower-pitched region and for enhanced "low action" that is particularly important for an instrument such as the Chapman Stick that is played in a two-handed string-tapping mode known as "Free Hands" from the title of Chapman's Stick lesson book, first published in 1974.

BACKGROUND OF THE INVENTION

In stringed musical instruments such as guitars and bass guitars, a main component is the neck that provides or supports a fretboard or a fretless fingerboard. The neck is typically made from wood and is ordinarily supplied initially as being nominally straight along its working length, free of neck curvature. The neck is usually attached to an end of the instrument body, however it may extend through the body in special through-neck type instrument construction. The front portion of the neck that is associated with the fretboard/fingerboard may extend part way onto the body.

In conventional wood neck construction, metal frets are inserted individually into transverse slots or channels configured on the front side of the fretboard or neck, where the frets may be held in place by friction-fit alone, depending on close dimensional tolerances in the frets and slots or channels, or further secured by glue.

Typically, in conventional instrument fabrication practice, all frets are initially made to be nominally uniform in height throughout the fretboard region, and in the initial instrument set-up the string-to-fret clearance is first set by the bridge/nut and by neck-truss adjustment (if available) to an overall optimal first approximation.

Due to non-uniformity of conventional wooden materials, even a newly fabricated neck may already have some amount of inherent curvature, concave or convex, and such bowing or arching is not always symmetrical over the neck length, requiring an excessive amount of fret-tip "dressing" by manually filing material from individual fret-tips so as to optimize the string-to-fret clearances individually and collectively.

For stringed instruments in initial setup or refurbishing, a luthier or instrument technician strives to achieve a desired string-to-fret clearance profile throughout the neck-length utilizing all available adjustment capability: e.g. the basic bridge and nut heights supplemented by whatever neck curvature adjustment may be available from a neck truss system to modify the profile of the fret-tips for desired pattern of string-to-fret clearances across and along the length of the neck, with compensation for string thickness.

In instrument set-up by a technician or luthier, even a substantially straight neck with uniform frets and low string clearance throughout the neck length is not considered adequate for optimal performance. The luthier strives to provide "relief", i.e. a shallow concave curvature in the fret-tip profile over a selected portion of the lower-pitched neck region, typically extending from the second fret to the twelfth fret, and a relatively straight profile throughout the higher-pitched neck region on the same plane as the first fret. After preliminary neck-shaping utilizing truss adjustment to the extent available, "relief" profiling requires special dressing by the luthier judiciously filing material from fret-tips in a lower-pitched region of the fretboard to obtain the optimal overall profile of the collective fret-tips. This is a costly operation, demanding the high skill level and experience of a luthier, that often becomes a tedious trial-and-error process requiring repeated cycles of "dressing" the fret-tips: stringing/unstringing/sanding/filing and crowning, before reaching a satisfactory result.

DISCUSSION OF KNOWN ART

U.S. Pat. No. 5,233,122 issued in 1993 to Kim for GUITAR WITH NECK TRUSS ROD SUPPORTING CONSTRUCTION exemplifies the use of inserted discrete frets along with a type of truss that attempts to prevent neck "cracking and bowing" by functioning strictly as a "brute-force" non-adjustable neck-stiffening beam element with no longitudinal stress applied.

U.S. Pat. No. 5,864,073 for LAMINATED NECK FOR GUITARS AND COMBINATION THEREOF WITH ADJUSTMENT SYSTEM issued in 1999 to Carlson, assigned to Fender Musical Instrument Corporation, typifies the use of inserted discrete frets in traditional trussed stringed instrument neck construction of a type that has found wide usage in known art.

U.S. Pat. No. 4,557,174 issued in 1985 to Gressett, Jr., assigned to Fender, discloses a GUITAR NECK INCORPORATING DOUBLE-ACTION TRUSS ROD APPARATUS. The neck, using conventional inserted discrete frets, is fitted with a truss system described as providing "compressive or tensile loading of the truss rod for flexing of the neck in either direction".

U.S. Pat. No. 4,953,435 issued in 1990 to the present inventor, Emmett H. Chapman, for REAR-ACCESS TRUSSED NECK CONSTRUCTION FOR STRINGED MUSICAL INSTRUMENTS, discloses improved trussed neck structure, utilizing inserted discrete frets, that was incorporated as a refinement in the Chapman Stick® where low action is desired to facilitate a special string-tapping playing technique (see U.S. Pat. Nos. 3,833,751, 3,868,880 and 4,953,435 by the present inventor). A substantially straight truss member is disposed uniformly in a groove along the rear side of the neck such that a surface of the truss is exposed along its full length, flush with the rear neck surface. A readily accessible rear-access threaded fabrication/service adjustment member provides convenient capability of applying an adjustable amount of either tension or compression as required to offset an unwanted neck-bending tendency in either direction, concave or convex, thus correcting and securing the neck in a straightened, stabilized condition. A currently pending patent application by Chapman discloses a four-way action truss system that can adjust the shape of two portions of the neck independently, each in a concave or convex direction.

Years of experience with wooden necks have revealed many instances where a further degree of neck adjustment capability is required. In some necks, particularly in the longer necks of a bass guitar or Stick, there may be unwanted curvature that, in the absence of compensation, is not uniformly distributed along the total length; instead it may be asymmetric, e.g. predominant in one or other half of the total neck length, so that it cannot be fully compensated by adjustment of a full length truss rod whether in compression or in tension.

U.S. Pat. No. 6,051,765, issued in 2000 to Regenberg et al for a GUITAR WITH CONTROLLED NECK FLEX, utilizing conventional inserted frets, teaches dividing the total truss rod length into three regions with the two spacers, each acting in compression against the fingerboard to act on curvature.

In the above-described and other known prior art in stringed musical instruments, the effects of variations in the wood neck and in its truss system are added to the inherent variations and instabilities of discrete fret insertion interfaces, combining to create general problems in optimizing the initial instrument setup in manufacturing and in providing the necessary stability to retain a good set-up stabilized over a reasonable length of time under the sometimes adverse conditions of road usage, along with difficulties in required field service by an owner or in a shop when necessary. There is an unfulfilled need to facilitate the satisfactory attainment and retention of the ideal flat profile of fret-tips plus "relief" commonly sought by luthiers, i.e. that of a shallow depression in a designated lower-pitched neck portion, made deeper for thicker strings, and a relatively flat profile throughout the mid- and higher-pitched neck region.

OBJECTS OF THE INVENTION

A primary object of the present invention is to provide an improved precision neck and fretboard construction for stringed musical instruments that, in manufacture and field service, facilitates the attainment of a desired low string-to-fret clearances throughout the fretboard and counteracts initial and long-term neck deformation under string stress, thus ensuring long-term retention of the desired clearances for low action and light touch.

It is a further object to provide an integrated stringed musical instrument fretboard construction wherein all frets are formed integrally with the fretboard from a single block of material, thus improving fret uniformity and stability over conventional retention of separate frets in slots or channels.

It is a further object, in original manufacture and in repair operations, to utilize the uniformity and accuracy of CNC machined integral frets to minimize initial dressing requirements, user maintenance and in-shop repairs.

It is a still further object to produce the integrated fretboard in an embodiment featuring "low action", with the fret-tips automatically machine-dressed to high accuracy under CNC in a predetermined collective fret-tip pattern that provides "relief", i.e. an increase in string-to-fret clearance in a designated low-pitched region of the fretboard for enhanced playing performance with minimal buzz from unwanted string contact with frets in the higher-pitched region above a played fret.

It is a still further object to provide an embodiment wherein the integrated fretboard portion is made to be detachable from the instrument neck to facilitate factory return in service operations for purposes of reshaping the frets with CNC machine accuracy and efficiency.

SUMMARY OF THE INVENTION

These and other objects and advantages have been accomplished in the present invention of the Railboard, an improved integrated fretboard structure for a stringed musical instrument wherein a fretboard is made with integral frets, machined under CNC from a block of material that is more stable than wood, to be attached to or made integral with the neck. The frets are initially machined to a desired cross-sectional shape, e.g. rounded as in conventional instruments or triangular as shown herein. Then in a second machining operation the fret-tips are shaved to slightly flattened tips, aligned in a common plane. Then in a third machining operation the fret-tips are dressed to form a special contour to produce "relief", i.e. deviating from the common plane with an increased string-to-fret clearance pattern in the lower-pitched fretboard region, thus enabling setup for very low playing "action" without buzzing of strings on next higher-pitched frets. High material stability and the repeatable precision of CNC machine dressing of the fret-tips facilitate the fabrication of a high quality instrument while potentially eliminating the cost and time consumption of fret-tip "dressing" by tedious manual filing and crowning which normally require the services of a skilled and experienced luthier.

A full understanding of this invention will be gained through a study of the accompanying drawings along with the following descriptive text.

DETAILED DESCRIPTION

Figure 1:
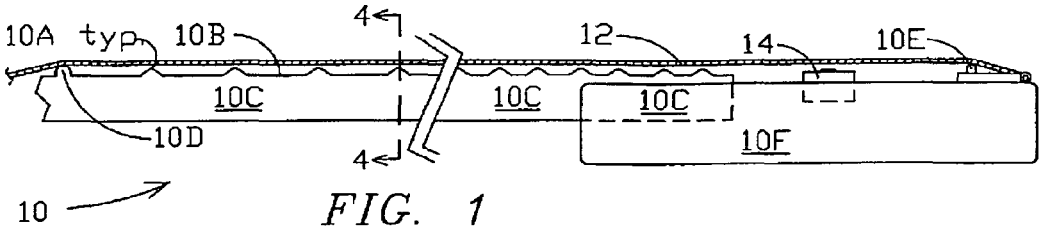
FIG. 1 is a side view of a stringed musical instrument of the guitar family incorporating an embodiment of the Railboard of the present invention wherein the frets, fretboard and neck are formed integrally by CNC machining from a single block of material.

FIG. 1 is a side view of a major portion of a stringed musical instrument such as a guitar or electric bass guitar incorporating, as a Railboard embodiment, a combined fretboard/neck 10 of the present invention wherein the fretboard portion including the frets 10A and the inter-fret surface regions 10B are formed integrally with the neck portion 10C by CNC machining from a single block of material such as aluminum grade 7075. The strings 12 are supported at the ends of their vibrating portion by a "nut" 10D at the left hand low-pitched region, optionally made as part of fretboard/neck 10, and anchored at the right hand end by a "bridge" 10E on the front side of the instrument body 10F, which is attached to the right hand end of neck portion 10C, typically bolted in the case of a solid body electric guitar. In electric guitars and basses, a pickup 14 is typically located as shown at an optimal distance from the bridge 10E, with pickup poles close behind strings 12.

Figure 2:
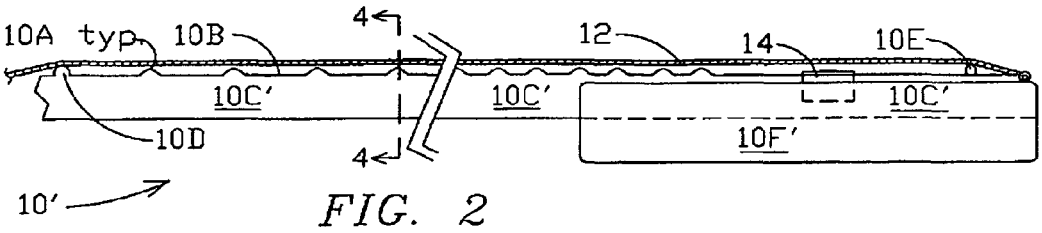
FIG. 2 is a side view of a stringed musical instrument of the guitar family similar to that in FIG. 1 but with a through-neck extending though the instrument body.

FIG. 2 is a side view of a major portion of a musical instrument such as a guitar or electric bass guitar similar to that of FIG. 1 but configured with a through-neck 10C' extending though the body 10F', incorporating, as a Railboard embodiment, a combined fretboard/neck 10' of the present invention, wherein the extended fretboard portion including frets 10A and inter-fret surface regions 10B and, optionally, nut 10D' and bridge 10E', are all formed integrally with through-neck 10C' by precision CNC machining from a single block of material.

Figure 3:
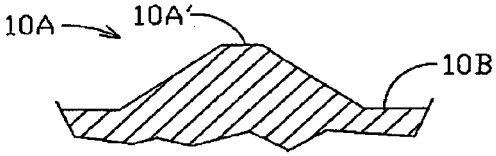
FIG. 3 is an enlarged cross-section showing the shape and flat tip of a typical fret in FIGS. 1 and 2.

FIG. 3 is an enlarged cross-section showing the shape and flat tip of a typical fret 10A, as in FIGS. 1 and 2, extending from fretboard inter-fret surface regions 10B in a triangular shape with a narrow flat tip 10A'. The two symmetrically sloping opposite flat sides of fret 10A are machined with the angle between them preferably within a range 90 to 120 degrees: nominally 110 degrees.

The fret-tips 10A' are typically machined initially with a sharp corner at the apex; in a second CNC machining operation all of the fret-tips are shaved down approximately 0.010 inches to form a flat plateau at the tip 10A' as shown, about 0.025 inches wide and spaced about 0.060 inches from the inter-fret surface region 10B. In a third CNC machining operation, some of the frets 10A in the low pitched regions, designated for "relief" dressing, are further shaved by varying amounts as required for a slightly concave collective fret-tip contour, additionally removing up to about 0.015 inches of material and thus increasing the width of fret-tip plateaus to as much as 0.065 inches at the deepest point in the "relief" region.

Figure 4:
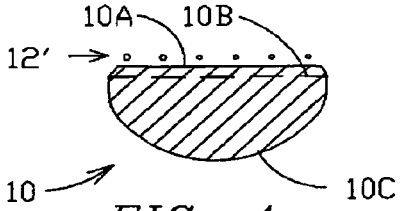
FIG. 4 is a cross-section of the neck region of six-string guitar embodiments of the Railboard taken thru axis 4 of FIGS. 1 and 2.

FIG. 4 is a cross-section of the neck region of Railboard embodiment wherein a combined fretboard/neck 10 and 10' is incorporated into a typical six-string guitar. The cross-section is taken thru a fret 10A at axis 4 of FIGS. 1 and 2, showing the shape of neck portion 10C which is made integral with the fingerboard portion (including the inter-fret surface regions 10B indicated by the dashed line) and frets 10A, by CNC machining from a single block of material, typically metal such as aluminum.

The string clearances are typically adjusted at the bridge and the nut to be spaced close to the fret-tips all along the Railboard, increasing by as much as 0.015 inches in the "relief" region located within the lower-pitched portion of the fretboard, typically extending between the second and the twelfth frets. The typical location of the flat fingerboard front surface regions 10B straddling fret 10A is indicated by the dashed line in FIG. 4, generally parallel with the tip of fret 10A.

Figure 5:
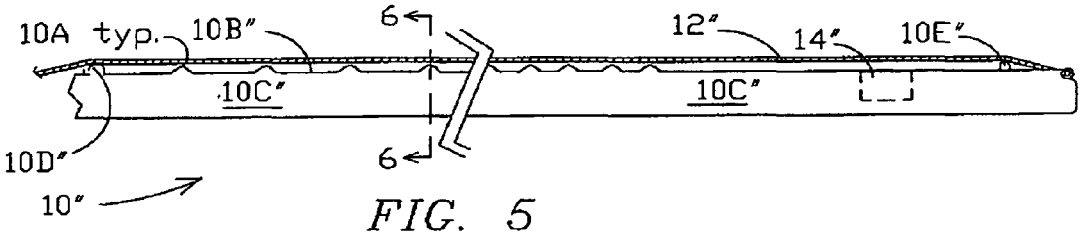
FIG. 5 is a side view of an embodiment of the Railboard of the present invention incorporated in a tapping-type stringed instrument such as the Chapman Stick®.

FIG. 5 is a side view of a Railboard embodiment wherein a combined fretboard/neck 10' of the present invention is incorporated in a tapping-type stringed instrument such as the Chapman Stick® featuring through-neck construction. As in FIG. 2, the extended fretboard configured with frets 10A and inter-fret surface regions 10B and optionally the nut 10D" and bridge 10E", are all formed integrally with neck portion 10C in the combined fretboard/neck 10" by precision CNC machining from a single block of material.

Figure 6:
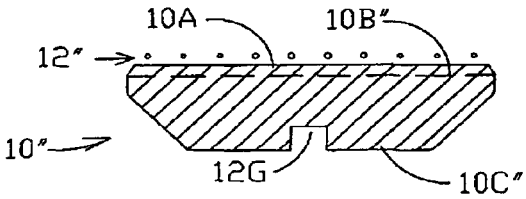
FIG. 6 is a cross-section of the neck region of a ten-string tapping-type stringed instrument embodiment of the Railboard taken thru axis 6 of FIG. 5.

FIG. 6 is a cross-section taken thru a fret 10A at axis 6 of FIG. 5, showing the shape of the neck portion 10C" including a channel 12G configured in the rear side for accommodating a truss rod. As in FIG. 4, the location of the flat fingerboard front surface region 10B between frets (10A) is indicated by the dashed line. As in FIG. 2, the full-length fretboard and (optionally) nut 10D" and bridge 10E", are all formed integrally with neck portion 10C" by precision CNC machining from a single block of material.

Figure 7:
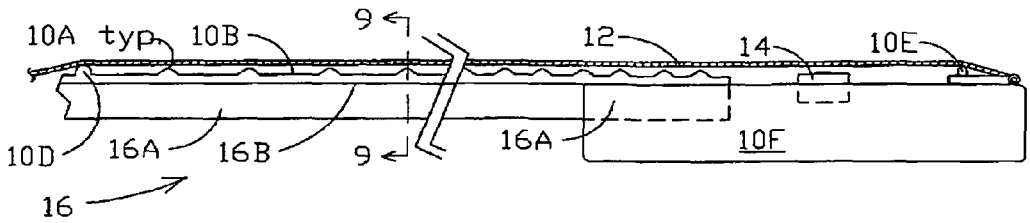
FIG. 7 is a side view of a stringed musical instrument of the guitar family corresponding to that of FIG. 1 except that the fretted Railboard is configured as a flat slab attached to a separate neck portion.

FIG. 7 is a side view of a musical instrument such as a guitar or bass, incorporating, as a Railboard embodiment, a two-part fretboard/neck assembly 16' functionally equivalent to the combined fretboard/neck 10 of FIG. 1. The fretboard 16B is configured in a slab-like shape and attached to a separate neck portion 16A which extends to an end attached to the instrument body 10F, typically attached by bolts. The fretboard 16B, configured with frets 10A, inter-fret surface regions 10 and optionally nut 10D, is formed integrally by precision CNC machining from a single block of material.

Figure 8:
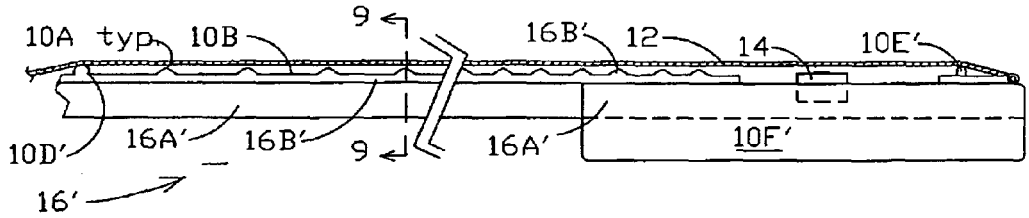
FIG. 8 is a side view of a stringed musical instrument of the guitar family with a through-neck corresponding to that of FIG. 2 except that the Railboard is configured as a flat slab fingerboard attached to a separate neck.

FIG. 8 is a side view of a musical instrument such as a guitar or bass with a through-neck incorporating, as a Railboard embodiment, a two-part fretboard/neck assembly 16' wherein the fretboard 16B' is configured in a slab-like shape, similar to fretboard 16B in FIG. 7, and attached to the separate neck 16A', that extends through the instrument body 10F' so as to accommodate the bridge 10E', while the fretboard 16B' typically extends over only a selected portion of the instrument body 10F', as shown. Railboard embodiment 16' includes the fretboard 10B with frets 10A, inter-fret surface regions 10B, and optionally nut 10D' and/or bridge 10E' formed integrally by precision CNC machining from a single block of material.

Figure 10:
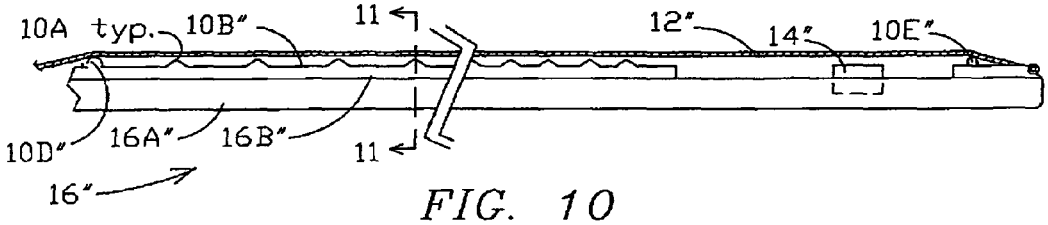
FIG. 10 is a side view of a tapping-type stringed instrument such as the Chapman Stick ® corresponding to that of FIG. 5 except that the fretted Railboard is configured as a flat slab attached to a separate neck portion.

FIG. 10 is a side view of a two-part fretboard/neck assembly 16" incorporated in a tapping-type stringed instrument such as the Chapman Stick® corresponding to that of FIG. 5 illustrating Railboard embodiment wherein the fretboard 16B" is configured with the frets 10A and the inter-fret surface regions 10B", in a flat slab-like shape and attached at a rear surface to a separate neck 16A". As in the through-neck construction described in connection with FIG. 8, the neck 16A" is made to extend full-length to the right to accommodate bridge 10E", while the fretboard 16B" typically extends over only a selected portion of the neck 16A", as shown. In the case of the Chapman Stick®, there is no conventional body; only a relatively small detachable module associated with pickup 14".

Figure 9:
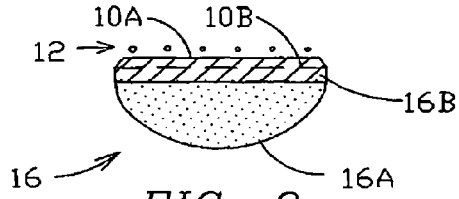
FIG. 9 is a cross-section of the neck region of a six-string guitar embodiment of the Railboard taken thru axis 9 of FIGS. 7 and 8.
Figure 11:
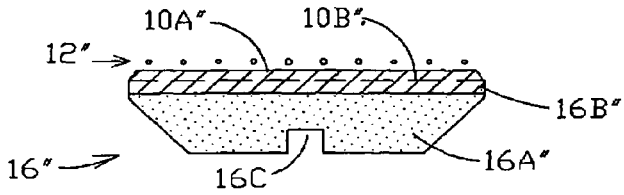
FIG. 11 is a cross-section of the neck region of a ten-string tapping-type stringed instrument embodiment of the Railboard taken at axis 11 of FIG. 10.

FIG. 11 is a cross-section taken through axis 11 of FIG. 10 showing the cross-sectional shape of fretboard/neck assembly 16" wherein fretboard 16B", is attached to the separate neck 16A" as incorporated into a tapping-type stringed instrument such as the Chapman Stick® as described in connection with FIG. 10. As in FIGS. 4, 6 and 9, the location of the fretboard front surface regions 10B" straddling fret 10A" is indicated by the dashed line.

It should be understood for purposes of this disclosure that while the surface of the fretboard 10B between frets 10A is commonly made flat as shown in profile in FIGS. 1,2, 5, 7, 8 and 10, and is commonly made flat transversely as indicated by the dashed line in the cross-sectional views of FIGS. 4, 6, 9 and 11, the invention can be practiced with the fingerboard front surface made to have a moderately convex curvature transversely as found on many stringed instruments. For such arched fretboards, the frets, nut and bridge are made to be arched accordingly so as to maintain generally uniform fret height above the arched fretboard and generally uniform string-to-fret clearances, and the regular fret-tips (other than "relief" portions) would be located generally in a common cylindrical plane rather than in the common flat plane as shown.

As an option, it is generally beneficial to attach the Railboard to other components such as the neck or body in such a manner, e.g. by bolts or screws, that the Railboard can be readily detached, thus enabling shipping and handling of the Railboard alone to avoid risk of damage to the remaining components such as the neck or body in connection with after-market service operations such as factory CNC reshaping of the frets.

As an option in Railboard embodiments such as FIGS. 7-11 wherein the Railboard is attached to a separate neck at a flat interface, rather than direct attachment, an interface layer of specially selected material of selected thickness could be utilized to obtain desired modification of the tonal characteristics of the instrument.

Optionally, the instrument neck may be equipped with some form of adjustable neck truss that will enable further control over neck shape and thus over the contour of the collective fret-tips for optimal string-to-fret clearance. This invention in combination with the inventor's four-way truss rod (patent pending) enables bass string relief to be increased while providing a smaller amount of relief for the higher pitched strings in the relief region of the fretboard.

This invention may be embodied and practiced in other specific forms without departing from the spirit and essential characteristics thereof. The present embodiments therefore are considered in all respects as illustrative and not restrictive. The scope of the invention is indicated by the appended claims rather than by the foregoing description. All variations, substitutions, and changes that come within the meaning and range of equivalency of the claims therefore are intended to be embraced therein.

What is claimed is:

1. A Railboard, made as a one-piece structure to serve as a fretboard, an associated set of frets and a neck of a stringed musical instrument, comprising:

a neck portion;

a fretboard portion configured integrally in a front surface region of said neck portion, an associated set of frets configured integrally with said fretboard portion on a front surface thereof, each fret in said set of frets traversing said fretboard portion and being configured with a substantially uniform cross-sectional shape having two sides extending forwardly from the front surface of said fretboard portion and converging substantially in mirror-image symmetry to a fret-tip region of string contact; and said Railboard being machine-formed from a single piece of non-wood rigid material.

2. The Railboard as defined in claim 1 wherein the rigid material is a metal.

3. The Railboard as defined in claim 1 wherein said Railboard is precision-machined under computer numerical control to form the one-piece structure accurately from a single piece of the rigid material.

4. The Railboard as defined in claim 1 wherein each fret in said set of frets is shaped in cross-section generally as a triangle with two flat sides extending from a base side at the front surface of the fretboard and converging to a fret-tip that is configured as a narrow flat plateau generally parallel with the front surface of the fretboard.

5. The Railboard as defined in claim 1 wherein the stringed musical instrument is a guitar and wherein the integrated one-piece neck/fingerboard/frets structure of said neck portion is shaped to simulate overall neck portion outline appearance and playing feel of guitars utilizing discrete separate frets set into fingerboard slots.

6. The Railboard as defined in claim 1 wherein the stringed musical instrument is an electric bass instrument wherein the integrated one-piece neck/fingerboard/frets structure of said neck portion is made longer than that of a typical guitar and shaped to simulate overall neck portion outline appearance and playing feel of electric bass instruments utilizing discrete separate frets set into fingerboard slots.

7. The Railboard as defined in claim 1 wherein the stringed musical instrument is made and arranged to be played with a two-handed string-tapping technique and wherein the integrated one-piece neck/fingerboard/frets structure of said neck portion is shaped to simulate overall neck portion outline appearance and playing feel of string-tapping type instruments utilizing discrete separate frets set into fingerboard slots.

8. The Railboard as defined in claim 1 wherein said frets, being each configured initially with an apex-shaped tip surface, are dressed by CNC machining in a manner to make the tip surfaces uniformly flat in a common plane.

9. The Railboard as defined in claim 8 wherein a predetermined plurality of said frets located in a selected lower-pitched region of said fretboard portion, are further dressed by CNC machining the flat tip surfaces thereof in a manner to collectively form a predetermined relief pattern of concave depression in the selected lower-pitched region.

10. A Railboard, made as a one-piece structure to serve as a fretboard and an associated set of frets of a stringed musical instrument, comprising:

said Railboard having a front surface configured as a fretboard and a rear surface made and arranged to be attached to a matching front surface of a neck of the stringed musical instrument;

an associated set of frets configured integrally with said fretboard on the front surface thereof, each fret in said set of frets traversing said fretboard and being configured with a substantially uniform cross-sectional shape having two sides extending from the front surface of said fretboard and converging substantially in mirror-image symmetry to a fret-tip region of string contact; and said Railboard being machine-formed from a single piece of non-wood rigid material.

11. The Railboard as defined in claim 10 wherein said Railboard is configured to have a slab-like shape and wherein the rear surface of said Railboard and the matching front surface of the neck are made flat and interface in a flat plane.

12. The Railboard as defined in claim 10 wherein the rigid material is a metal.

13. The Railboard as defined in claim 10 wherein the rigid material is precision-machined under computer numerical control to form said structure accurately from a single piece of the rigid material.

14. The Railboard as defined in claim 10 wherein the stringed musical instrument is a guitar and wherein the instrument neck portion and the integrated one-piece fretboard/frets structure are shaped to simulate overall neck portion outline appearance and playing feel of guitars utilizing discrete separate frets set into fingerboard slots.

15. The Railboard as defined in claim 10 wherein the stringed musical instrument is a guitar-like instrument made and arranged to be played with a two-handed string-tapping technique, and wherein the instrument neck portion and the integrated one-piece fingerboard/frets structure are shaped to simulate overall neck portion outline appearance and playing feel of string-tapping type instruments utilizing discrete separate frets set into fingerboard slots.

16. The Railboard as defined in claim 10 wherein the stringed musical instrument is a bass guitar-like instrument made and arranged to be played with a two-handed string-tapping technique, and wherein the instrument neck portion and the integrated one-piece fingerboard/frets structure are shaped to simulate overall neck portion outline appearance and playing feel of two-handed string-tapping type bass guitar-like instruments utilizing discrete separate frets set into fingerboard slots.

17. The Railboard as defined in claim 10 wherein the stringed musical instrument is configured as a Chapman Stick® embodiment and wherein the instrument neck portion and the integrated one-piece fingerboard/frets structure are shaped to simulate overall neck portion outline appearance and playing feel of Chapman Stick instruments utilizing discrete separate frets set into fingerboard grooves.

18. A method of manufacturing a Railboard including a fretboard of unusual precision and stability, integrated with an associated set of frets of unusual precision and stability, for a stringed musical instrument, comprising the steps of:

(1) in a first computer numerically controlled machining operation, configuring said fretboard and frets from a single piece of rigid material, shaping a fretboard with a row of frets and having a plurality of flat surfaces between the frets in a common fretboard plane, and shaping tips of the frets to each form, in cross-section, a sharp-cornered apex with all such apexes generally aligned in a common flat plane parallel with the fretboard plane;

(2) in a second computer numerically controlled machining operation, removing material from the tip of each fret so as to form a flat plateau with all such flat plateaus aligned in a common flat plane parallel with the fretboard plane; and (3) in a third computer numerically-controlled machining operation, removing material from tips of predetermined ones of said frets located in a designated low-pitched portion of said fretboard in a manner to form a slightly depressed concave relief contour region of the collective plateaus that deviates from the common flat plane by a greater extent in locations associated with thicker strings and by a lesser extent in locations associated with thinner strings.

19. The method of manufacturing a Railboard as defined in claim 18, wherein, in step (1), the machining operation is made to configure the Railboard to include an instrument neck integrated with the fretboard and frets, machined integrally from the single piece of rigid material.

20. The method of manufacturing a Railboard as defined in claim 18 wherein the stringed musical instrument is a guitar and the instrument neck portion, including the integrated one-piece fingerboard/frets structure, is shaped to simulate overall neck portion outline appearance and playing feel of well-known guitars utilizing discrete separate frets set into fingerboard slots.

21. The method of manufacturing a Railboard as defined in claim 18 wherein the stringed musical instrument is a guitar-like instrument made and arranged to be played with a two-handed string-tapping technique and wherein the instrument neck portion, including the integrated one-piece fingerboard/frets structure, is shaped to simulate overall neck portion outline appearance and playing feel of string-tapping guitar-like instruments utilizing discrete separate frets set into fingerboard slots.

22. The method of manufacturing a Railboard as defined in claim 18 wherein the stringed musical instrument is a bass guitar-like instrument made and arranged to be played with a two-handed string-tapping technique and wherein the instrument neck portion, including the integrated one-piece fingerboard/frets structure, is shaped to simulate overall neck portion outline appearance and playing feel of string-tapping bass guitar-like instruments utilizing discrete separate frets set into fingerboard slots.

23. The method of manufacturing a Railboard as defined in claim 18 wherein the stringed musical instrument is configured as a Chapman Stick embodiment wherein the instrument neck portion, including the integrated one-piece fingerboard/frets structure, is shaped to simulate overall neck portion outline appearance and playing feel of Chapman Stick instruments utilizing discrete separate frets set into fingerboard grooves.

24. The method of manufacturing a Railboard as defined in claim 18 wherein, in step (1), said fretboard is machined so as to shape the rear surface in a manner to be attached to a neck of the instrument, and wherein said method further comprises the additional step of (4) attaching said fretboard to a matching surface of the instrument neck interfacing the rear surface of the fretboard.

25. The method of manufacturing a Railboard as defined in claim 24 wherein the stringed musical instrument is a guitar and the instrument neck portion, including the integrated one-piece fingerboard/frets structure, is shaped to simulate overall neck portion outline appearance and playing feel of guitars utilizing discrete separate frets set into fingerboard slots.

26. The method of manufacturing a Railboard as defined in claim 24 wherein the stringed musical instrument is an electric bass guitar and the instrument neck portion, including the integrated one-piece fingerboard/frets structure, is made longer than that of a typical guitar and is shaped to simulate overall neck portion outline appearance and playing feel of electric bass guitar instruments utilizing discrete separate frets set into fingerboard slots.

27. The method of manufacturing a Railboard as defined in claim 24 wherein the stringed musical instrument is a guitar-like instrument made and arranged to be played with a two-handed string-tapping technique and the instrument neck portion, including the integrated one-piece fingerboard/frets structure, is shaped to simulate overall neck portion outline appearance and playing feel of string-tapping guitar-like instruments utilizing discrete separate frets set into fingerboard slots.

28. The method of manufacturing a Railboard as defined in claim 24 wherein the stringed musical instrument neck is configured as a Chapman Stick embodiment and the instrument neck portion, including the integrated one-piece fingerboard/frets structure, is shaped to simulate overall neck portion outline appearance and playing feel of Chapman Stick instruments utilizing discrete separate frets set into fingerboard grooves.

* * * * *